US006513905B2

(12) United States Patent
Pan et al.

(10) Patent No.: US 6,513,905 B2
(45) Date of Patent: Feb. 4, 2003

(54) NOZZLE CROSS TALK REDUCTION IN AN INK JET PRINTER

(75) Inventors: Yichuan Pan, San Diego, CA (US); John C. Love, San Diego, CA (US); David A. Neese, Escondido, CA (US); James Haflinger, San Diego, CA (US)

(73) Assignee: Encad, Inc., San Diego, CA (US)

( * ) Notice: Subject to any disclaimer, the term of this patent is extended or adjusted under 35 U.S.C. 154(b) by 0 days.

(21) Appl. No.: 09/728,719

(22) Filed: Dec. 1, 2000

(65) Prior Publication Data

US 2002/0067390 A1 Jun. 6, 2002

Related U.S. Application Data

(60) Provisional application No. 60/331,353, filed on Mar. 31, 2000.

(51) Int. Cl.[7] ..... B41J 2/15
(52) U.S. Cl. ..... 347/40; 347/12
(58) Field of Search ..... 347/40, 12, 15, 347/43, 16, 68, 54

(56) References Cited

U.S. PATENT DOCUMENTS

| | | | | | |
|---|---|---|---|---|---|
| 5,079,571 | A | * | 1/1992 | Eriksen | 347/43 |
| 5,142,296 | A | | 8/1992 | Lopez et al. | |
| 5,357,268 | A | | 10/1994 | Kishida et al. | |
| 5,438,350 | A | | 8/1995 | Kerry | |
| 5,648,805 | A | | 7/1997 | Keefe et al. | |
| 5,880,756 | A | * | 3/1999 | Ishii et al. | 347/40 |
| 5,923,349 | A | * | 7/1999 | Meyer | 347/43 |
| 6,106,102 | A | * | 8/2000 | Richtsmeier et al. | 347/41 |

* cited by examiner

*Primary Examiner*—Lamson Nguyen
(74) *Attorney, Agent, or Firm*—Milton S. Sales; Thomas R. Arno

(57) ABSTRACT

A column of ink ejection nozzles on an ink jet print head is arranged in a plurality of sub-columns. The number of sub-columns and the assignment of nozzles to the sub-columns is selected to reduce cross-talk between nozzles, to prevent overlap of ejection pulses between sub-columns, and to minimize the complexity of the electronics required to actuate the ink ejection nozzles for droplet deposition.

22 Claims, 7 Drawing Sheets

NOZZLE CROSS TALK REDUCTION IN AN INK JET PRINTER

CROSS REFERENCE TO RELATED APPLICATION

This application claims priority to prior U.S. patent application Ser. No. 09/454,782, entitled "NOZZLE CROSS TALK REDUCTION IN AN INK JET PRINTER," which was filed on Dec. 3, 1999, and which was converted to Provisional Application No. 60/331,353 on Mar. 31, 2000.

BACKGROUND OF THE INVENTION

1. Field of the Invention

The invention relates to ink jet print heads. Specifically, the invention relates to the geometric arrangement of ink jet nozzles in the head.

2. Description of the Related Art

In on-demand ink jet printing, a grid of pixel locations is defined on a print media surface. During the print process, each pixel location may receive a droplet of ink from a set of ink ejection nozzles on a print head as the print head passes horizontally over the print media surface. In many systems, the pixel grid may be considered to comprise a series of vertical columns of pixel positions, and the ejection nozzles are also arranged in a vertical column. The vertical spacing between nozzles corresponds to the vertical pixel spacing, which will typically be approximately 50 to 600 pixels per inch, resulting in a vertical inter-nozzle spacing of about 40 to 500 microns. As the vertical column of nozzles passes over each vertical column of pixel locations, the appropriate droplets are deposited. Because the vertical column of nozzles is typically much shorter in length than the total number of pixels in a vertical pixel column for the whole image, the printer may sequentially pass the print head over one horizontally extending swath of the image at a time, incrementing the media between each pass. In some cases, multi-pass ink jet printing techniques using overlapping swaths are used to increase image quality.

It will be appreciated that printing an image will often require the firing of a large percentage or even all of the print head nozzles as the print head passes over a given vertical pixel column. In many print head designs, however, the simultaneous firing of too many nozzles, especially adjacent nozzles, is undesirable. In thermally activated print heads, for example, the firing of too many nozzles simultaneously results in a large power dissipation which is expensive to supply and which causes an excessive temperature increase in the print head. In addition, in both thermally and piezoelectrically actuated print heads, the firing of one or a set of nozzles may cause droplet volume and velocity changes or may otherwise interfere with the firing of other nozzles of the print head.

To help resolve these problems, nozzle arrangements have been developed in which the nozzles are not arranged precisely in a vertical column but instead deviate from each other horizontally. This horizontal deviation is much narrower than the horizontal pixel spacing, which is often, although not always, identical to the vertical pixel spacing. In one such embodiment, described in detail in U.S. Pat. No. 5,648,805 to Keefe, et al., the nozzles in a vertical column are arranged in 21 horizontally displaced sub-columns. Other thermal print head embodiments which have been designed include 13 sub-columns. In the 21 sub-column print head described in the '805 patent, the vertical inter-nozzle spacing is about 85 microns, and each sub-column is horizontally displaced about 1.75 microns from the adjacent sub-columns. The total horizontal width of the 21 sub-columns is therefore about 36 microns. With a print head of this design, only one of the sub-columns is positioned directly over the center of a vertical pixel column at a time, and the nozzles for each sub-column are fired sequentially as each sub-column becomes properly positioned over the vertical pixel column. Thus, even if the vertical pixel column needs a deposited droplet on each pixel, only a few of the nozzles of the overall total need to be fired simultaneously.

Increasing the number of sub-columns reduces the maximum number of nozzles that must be fired simultaneously. However, as the number of sub-columns increases, the horizontal spacing between the sub-columns must decrease so that the first sub-column has not moved over the next vertical pixel column before the last sub-column deposits droplets onto the preceding vertical pixel column. A large number of sub-columns and the associated reduced sub-column spacing increases the complexity of the firing electronics, and may cause further nozzle cross talk issues due to the short time period between sub-column firing.

SUMMARY OF THE INVENTION

A drop-on-demand ink jet print head has a nozzle arrangement that reduces cross talk between nozzles with a minimal added complexity in firing electronics. In one embodiment, the invention comprises an ink jet print head comprising a column of ink ejection nozzles which is arranged in five to eight parallel sub-columns in such a way that no two vertically adjacent ink ejection nozzles are in either the same sub-column or are in two horizontally adjacent sub-columns. Parallel sub-columns may be spaced apart between approximately four and approximately 30 microns. Separation of nozzles of the column into sub-columns in this way provides a column of nozzles with a total width which is less than a print resolution unit of a printer the head will be used in, and also considerable cross talk reduction.

Ink jet printers including novel print heads are also provided. In one embodiment, an ink jet printer comprises a print head comprising a column of nozzles arranged in four to eight parallel sub-columns. The sub-columns are spaced apart such that the total width of the column of nozzles is less than one horizontal print resolution unit of the printer. In another embodiment, an ink jet printer comprises a platen forming a print surface, a media drive system configured to increment print media in a first direction over the print surface, and a movable print carriage configured to pass over the print media in a second direction perpendicular to the first direction between media drive system increments. The printer further comprises a piezoelectrically actuated drop-on-demand print head coupled to the moveable print carriage, wherein the drop-on-demand print head comprises one or more columns of nozzles extending in the first direction, each of which are arranged in five parallel sub-columns, wherein nozzle separation between the sub-columns in the second direction is approximately four to approximately thirty microns.

DETAILED DESCRIPTION OF THE PREFERRED EMBODIMENT

Embodiments of the invention will now be described with reference to the accompanying Figures, wherein like numerals refer to like elements throughout. The terminology used in the description presented herein is not intended to be interpreted in any limited or restrictive manner, simply because it is being utilized in conjunction with a detailed description of certain specific embodiments of the invention. Furthermore, embodiments of the invention may include several novel features, no single one of which is solely responsible for its desirable attributes or which is essential to practicing the inventions herein described.

Figure 1:
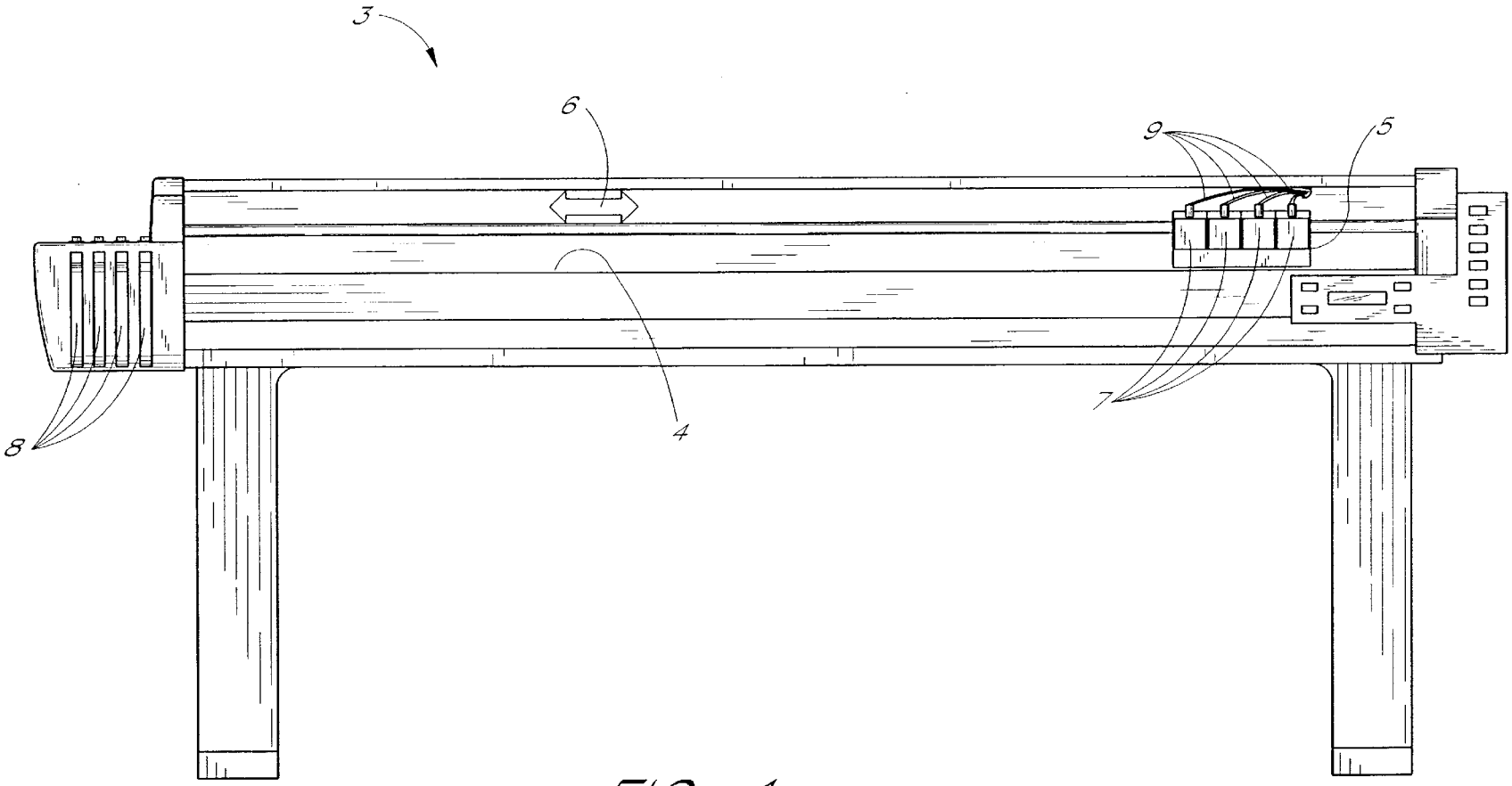
FIG. 1 is a front view of one embodiment of an ink jet printer which may incorporate the invention.

The invention has application to ink jet printers and printing methods, and accordingly, FIG. 1 illustrates one possible ink jet printer configuration which may embody the invention. The specific embodiment of FIG. 1 is a floor standing printer 3 comprising a platen 4 forming a printing surface. The printer also comprises a print carriage 5 which traverses horizontally across the platen 4 in the direction of arrow 6. Installed in the print carriage 5 are a plurality of ink jet print heads 7, which selectively eject ink droplets downward onto the print surface. Ink ejection is controlled by the printer to deposit ink droplets onto selected pixel locations of a grid of pixel locations having a given dot-per-inch (dpi) resolution in the horizontal and vertical dimensions. Each print head 7 receives ink from an ink reservoir 8 through an associated ink feed tube 9. During print operations, a media drive system advances a piece of media across the print surface in a direction perpendicular to the direction of carriage 5 travel (that is, into or out of the plane of FIG. 1) in between passes of the print carriage over the media surface. This process builds an image from a series of deposited swaths of ink droplets.

These aspects of ink jet printers are well known and conventional, and a wide variety of alternative configurations exits. For example, the print surface 4 could be oriented vertically rather than horizontally. Non-moving print heads may be used in page wide printing, wherein one or more ink jet print heads span the entire page width and printing is performed as the media is advanced beneath. The print heads may be drop-on-demand print heads which are thermally actuated or piezoelectrically actuated. In all of these embodiments, however, the print heads 7 comprise nozzle arrays for selectively ejecting droplets of ink onto the desired pixel locations at the resolution the printer was designed to perform at. Several nozzle array embodiments which are advantageously provided on ink jet printer print heads are described in additional detail below.

Figure 2:
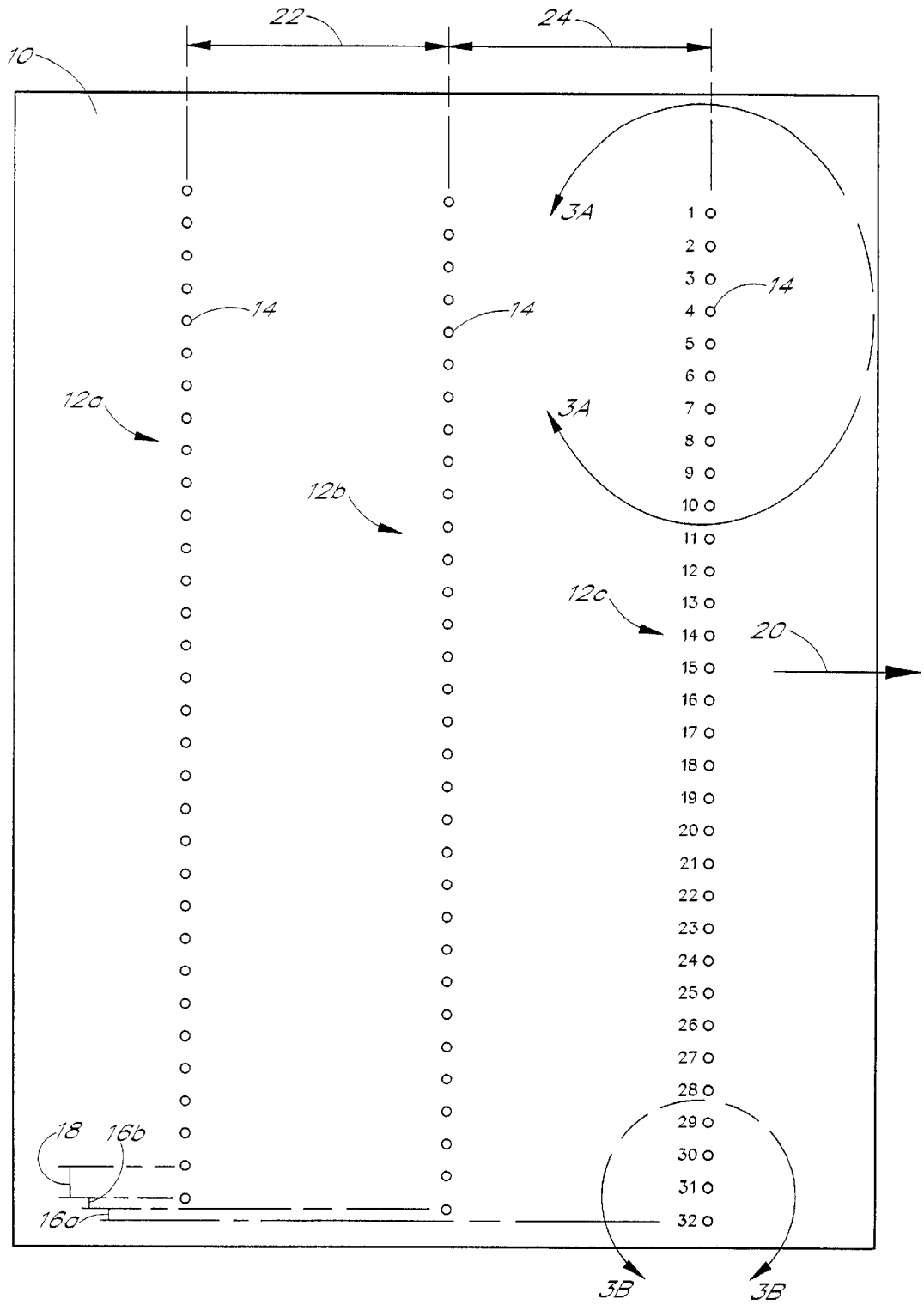
FIG. 2 is a front plan view of the face of an ink jet print head illustrating a nozzle arrangement placed thereon.

Referring now to FIG. 2, the face 10 of a print head is illustrated which includes three vertical columns 12*a*, 12*b*, 12*c* of nozzles. Each nozzle 14 communicates with a dedicated ink chamber behind the nozzle 14, each one of which is in turn in fluid communication with a larger common ink reservoir which replenishes the ink in the dedicated ink chamber after its associated nozzle has ejected an ink droplet. In one advantageous embodiment of the invention, the ink chambers are deformed with piezoelectric actuators so as to eject an ink droplet. A wide variety of piezoelectric ink ejection schemes are known to those of skill in the art, any one of which would could be used with the nozzle arrays and actuation methods of the invention. These may include, for example, piston ejectors, deforming side wall designs, or flexing membrane ejectors.

Figure 3A:
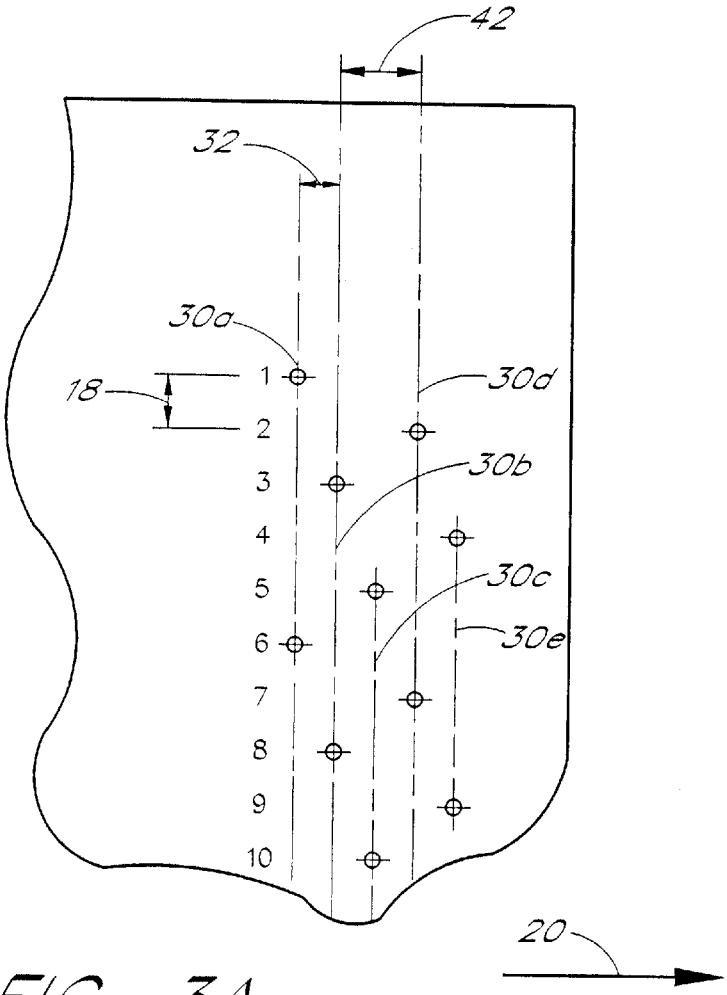
FIG. 3A is a close-up plan view of portion 2A of FIG. 1.
Figure 3B:
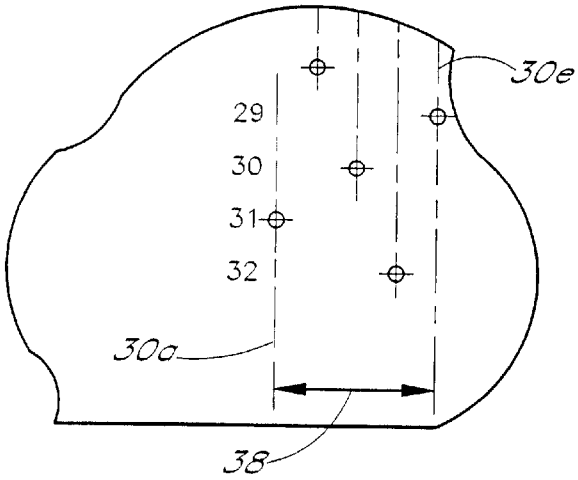
FIG. 3B is a close-up plan view of portion 2B of FIG. 1.

In the illustrated embodiment, each of the columns 12*a*, 12*b*, 12*c* have 32 nozzles. As will be explained in further detail below, and as is best illustrated in FIGS. 3A and 3B, the nozzles of each vertical column 12*a*, 12*b*, 12*c* are not exactly vertically aligned as they appear in FIG. 2, but are arranged into a plurality of horizontally spaced sub-columns. Although this multiple sub-column arrangement is important to printer operation, the horizontal displacement is relatively small compared to the vertical separation between nozzles, and is thus not illustrated visually in FIG. 2.

The vertical nozzle positions 16*a*, 16*b* for the three columns are vertically interleaved by one pixel spacing each, whereas the vertical nozzle spacing 18 within each column is three vertical pixel spacings. The horizontal separation 22, 24 between each column is generally much larger than the vertical nozzle separations, and may be 50, 100, or more horizontal pixel spacings. The distance 22, 24 is typically a selected integer number of horizontal pixel spacings, however, so that during the print process, the columns of nozzles 12*a*, 12*b*, and 12*c* cross over different vertical pixel columns simultaneously. The interleaving produces an overall vertical print resolution of three times the nozzles per inch provided in any one column 12*a*, 12*b*, 12*c*. In the embodiment of FIG. 1, if each column 12*a*, 12*b*, 12*c* were 50 nozzles per inch, the print head would print a vertically extending swath having a height of ninety-six 150 dpi pixels as it traveled across the media in the direction of arrow 20.

This multi-column interleaving technique is in widespread use in commercial print heads, and it will be appreciated that with appropriate vertical interleaving, two, four, or more separate horizontally separated nozzle columns may be provided. For example, in one embodiment of the invention, four groups of the three column arrangement illustrated in FIG. 1 are provided, with the four groups staggered at a pitch of 1/600 of an inch per group. This set of twelve columns, totaling 384 nozzles, may print at a vertical resolution of 600 dots per inch in a single pass. If each group of three columns is connected to a different color ink supply (cyan, magenta, yellow, and black, for example), the print head can print at a vertical resolution of 150 dpi for each color in a single pass mode, or 600 dpi for each color in a four pass mode. Horizontal print resolution is determined by the rate at which ink is ejected from the nozzle columns as the print head passes over the media in a horizontal direction. With the print head shown in FIG. 2, droplets may be ejected from each nozzle at up to 600 dpi horizontally.

FIGS. 3A and 3B show close up views of the top ten nozzles and bottom four nozzles respectively of the rightmost column 12*c* of FIG. 2. As can be seen in these Figures, the column of nozzles 12*c* is organized as five separate sub-columns, designated 30*a* through 30*e* in FIGS. 3A and 3B. At the top of each sub-column is one of the first five nozzles. Following the top nozzle, each sub-column includes every fifth following nozzle. Thus, if the first sub-column 30*a* begins with nozzle 1, the next nozzle of this sub-column is nozzle 6, then nozzle 11, etc. In the embodiment of FIGS. 3A and 3B, the second sub-column begins with nozzle 3, and continues with nozzle 8, nozzle 13, and so on. With this five sub-column embodiment, the top nozzles of the sub-columns 30*a*–30*e* are nozzles 1, 3, 5, 2, and 4 respectively.

As described above, in the embodiment of FIGS. 2 and 3, the spacing 18 between vertically adjacent nozzles in a column is one minimum vertical print resolution unit multiplied by the number of widely separated interleaved columns such as are designated 12*a*, 12*b*, and 12*c* in FIG. 2. In the twelve column specific embodiment described above, for example, the maximum vertical print resolution is 600 dpi, and the vertical nozzle separation within a column is therefore about 600/12=50 nozzles per inch, which is about a 508 micron vertical separation distance between vertically adjacent nozzles.

The separation between sub-columns, however, is significantly less than a single horizontal print resolution unit so that the nozzle column can print on every pixel location in the vertical pixel column segment beneath it before the nozzle column moves on to the next vertical column of pixels. Furthermore, to make the timing between sub-column firings consistent (as described in further detail below), it is preferable to separate the sub-columns by a distance which is equal to the lowest intended horizontal pixel spacing divided by the number of sub-columns. For the five column embodiment illustrated in FIGS. 3A and 3B for example, the minimum intended horizontal pixel spacing is 1/600 inches, or about 42 microns, and the horizontal sub-column spacing 32 is therefore about 8.5 microns, resulting a total column width 38 of about 34 microns.

It may be noted that for purposes of clarity of illustration, the horizontal nozzle spacings, vertical nozzle spacings, and nozzle diameters (which may be about 30 microns) shown in FIGS. 2, 3A, and 3B are not drawn to the same scale. With the dimensions specified above, the total horizontal width 38 of the column 12*c* is actually only about 6.7% of the vertical spacing between vertically adjacent nozzles.

As the print head passes over a vertical column of pixels in the direction of arrow 20, the nozzles in sub-column 30*e* are enabled first as this sub-column is the first one to be properly positioned. Similarly, sub-columns 30*d*, 30*c*, 30*b*, and 30*a* are successively enabled as they are successively positioned over the center of the vertical pixel column. Following ink ejection from sub-column, 30*a*, sub-column 30*e* is enabled as this sub-column becomes centrally positioned over the next adjacent vertical pixel column. Therefore, even when depositing droplets on every pixel in a vertical column, only a subset (about one-fifth) of the nozzles is ever fired simultaneously.

If the spacing between sub-columns is 1/5 of the horizontal pixel spacing, the time period between ink ejection from each sub-column is the same when printing within a selected pixel column and when advancing to the next adjacent pixel column. That is, the time between enabling sub-columns 30*c* and 30*b* within a pixel column is the same as the time period between enabling sub-column 30*a* when completing a first pixel column and enabling sub-column 30*e* to begin printing the next adjacent pixel column. For any given number of sub-columns, this consistent firing timing both between and within each print resolution unit requires the overall column width 38 to be substantially equal to the width of a horizontal print resolution unit (denoted herein as "r") times (n−1)/n, where n is the number of sub-columns provided in a nozzle column. Thus, for a two sub-column embodiment, the column width 38 is preferably ½ of a horizontal print resolution unit. For a ten sub-column embodiment, the column width 38 will preferably be 9/10 of a print resolution unit.

Figure 4:
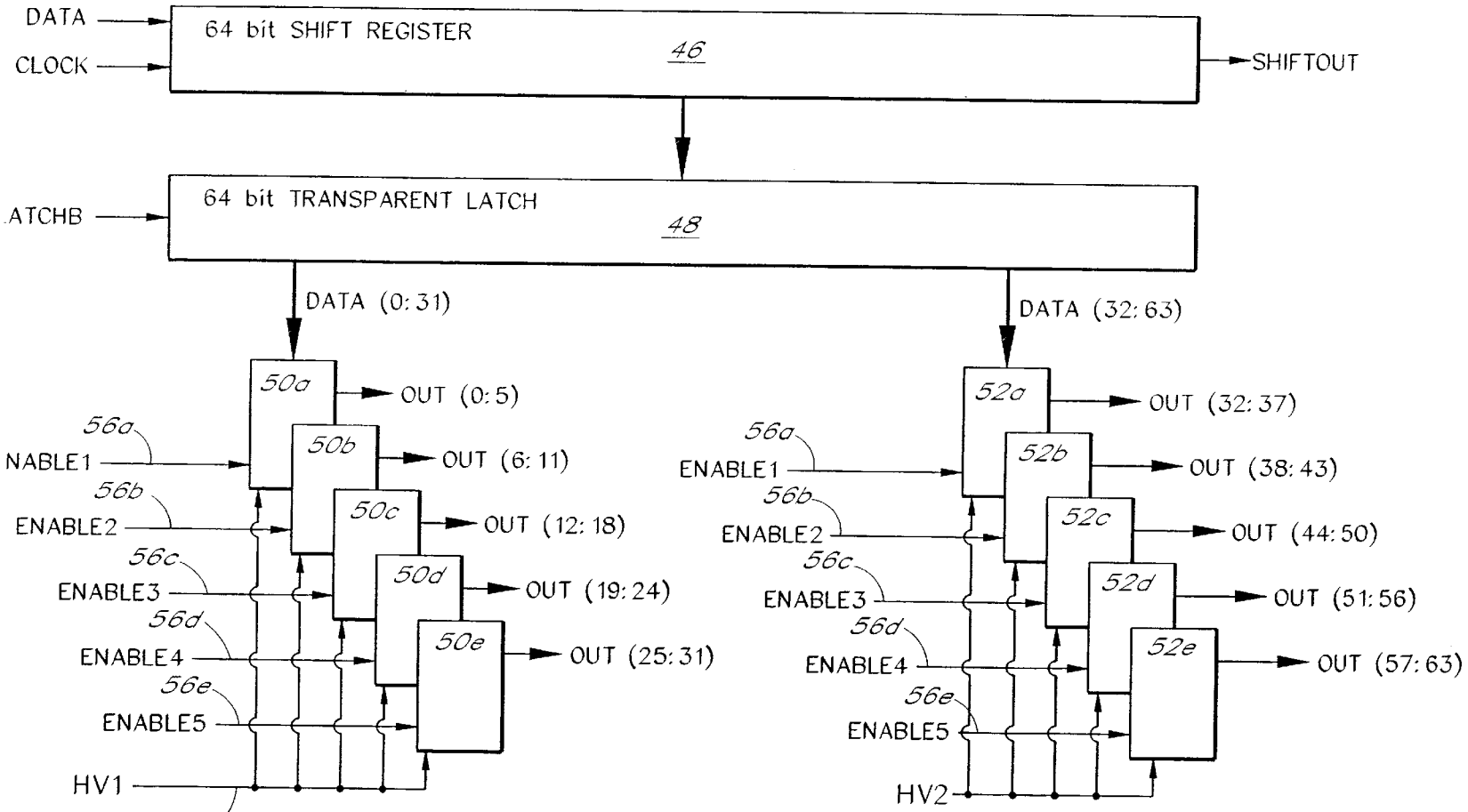
FIG. 4 is a schematic/block diagram of a nozzle actuation circuit suitable for a nozzle column having five sub-columns.

FIG. 4 shows a block diagram of nozzle actuation electronics which may be used to perform this sequential sub-column firing. The circuitry shown in FIG. 4 is advantageously implemented on an integrated circuit. The circuit shown may be used to actuate two columns of 32 nozzles. In one printer embodiment described above, for example, 12 nozzle columns are provided, with groups of three each dedicated to a different color ink. In this printer embodiment, six such integrated circuits may be provided to actuate the twelve columns of 32 nozzles each.

Each integrated circuit includes a 64 bit shift register 46 which receives print data from external electronics. A 64 bit word is shifted in for each vertical pixel column the print head passes over as it moves across the media to print an image. Bits 0–31 and 32–63 of the 64 bit print data word are associated with two columns of 32 nozzles respectively. Bits of the word are asserted if the nozzle associated with that bit is to be fired at the pixel location in the vertical column the print head is passing over.

The shift register 46 is coupled to a latch 48 which presents the data word to a series of gates 50*a* through 50*e* and 52*a* through 52*e* that selectively pass an actuating voltage 54 to the piezoelectric transducers in accordance with the content of the print data word and a timed enable input 56*a* through 56*e*. Each gate couples the actuating voltage 54 to the gate output if the corresponding bit is asserted and the relevant enable input is asserted. The first six gates designated 50*a* in FIG. 4 have data bits 0 to 5 respectively and the first enable signal 56*a* as inputs. The actuation voltage appears on output(0) if bit 0 is asserted and the first enable signal 56*a* is asserted. Similarly, the actuation voltage appears on output(1) if bit 1 is asserted and the first enable signal 56*a* is asserted. The other gates 56*b* through 56*e* operate in an analogous manner. For example, the actuation voltage appears on output(19) if bit 19 is asserted and the fourth enable signal 56*d* is asserted.

To perform the sequential sub-column actuation, the gate outputs associated with a selected enable signal are routed to the nozzles in a selected sub-column. For example, outputs 12–18 from gate 50*c* may be routed to the seven nozzles of sub-column 30*d* of FIGS. 3A and 3B. After a 64 bit word defining which nozzles are to eject droplets in that vertical pixel column is latched in, the five enable signals are sequentially asserted to deposit droplets one sub-column at a time as the nozzle sub-columns become properly positioned over the vertical pixel column of the media.

As discussed briefly above, nozzle arrangements in sub-columns within a column helps to reduce the interference with one nozzle firing that may be produced by other nozzles firing. As a broad generalization, to minimize this nozzle cross-talk, within a given column the distance between nozzles both horizontally and vertically should be maximized. However, there are several constraints on the optimum sub-column arrangement. If two nozzles which are close together are fired simultaneously, they will compete for the local ink supply when firing their respective droplets. The local ink supply pressure may therefore be altered for a selected nozzle depending on whether or not another nozzle which is close to the selected nozzle is fired at the same time or not. These local pressure variations result in undesirable drop volume and velocity variations in the droplets expelled from the nozzles during the print process. For piezoelectrically actuated print heads, structural cross-talk due to mechanical motion of piezoelectric elements can also be significant. Because the nozzles within each sub-column may be fired simultaneously, this form of cross-talk is reduced as the vertical distance 40 between nozzles in any given sub-column is increased. If the nozzles are evenly distributed in the sub-columns, this distance will be equal to the spacing 18 between vertically adjacent nozzles multiplied by the number of sub-columns. This distance can therefore be increased by providing more sub-columns. However, fitting more sub-columns within a horizontal print resolution unit requires a smaller horizontal distance 32 between sub-columns. If the sub-columns are placed too close together, the electrical nozzle actuation pulses for adjacent sub-columns will begin to overlap.

Because of the local ink pressure variations discussed above, in addition to the fact that the replenishment of ink to a local area of the print head following a given nozzle firing is not instantaneous, it is also preferable that nozzles which are close together vertically be far apart horizontally. Horizontal separation will produce a sufficient time delay between firings of vertically proximate nozzles to allow ink replenishment from the main supply. This general concept can be geometrically quantified in various ways. It has been found that one useful measure which may be used to characterize this type of cross-talk reduction benefit in a given sub-column arrangement is to evaluate the minimum horizontal distance between vertically adjacent nozzles. For example, in the five sub-column embodiment of FIG. 3A, the distance 42 between vertically adjacent nozzles 2 and 3 is equal to two sub-column distances 32.

Using these criteria, different sub-column arrangements can be evaluated. The smallest possible number of sub-columns is two. In this case, the horizontal distance between sub-columns should be half as wide as an entire print resolution unit. This would allow a relatively long time delay between actuation of each sub-column. However, each sub-column would contain every other nozzle in the column. The vertical separation between nozzles in each sub-column is therefore not large, and the two sub-column nozzle arrangement is found to retain significant inter-nozzle cross talk within each sub-column.

Several embodiments having more than two sub-columns are illustrated in FIGS. 5A through 5D in a graphical format which is not to scale dimensionally. As with the embodiment of FIGS. 2, 3A and 3B, sub-column arrangements for a 32 nozzle vertical column are illustrated. The graphical format of these Figures comprises a grid having 32 rows, one for each nozzle, and a set of columns corresponding to the number of sub-columns in the arrangement. It will be appreciated that the arrangements illustrated could be extended in the same manner to columns with a greater number of nozzles. The nozzle numbers 1–32 are placed in the grid locations indicating their sub-column assignments.

Figure 5C:
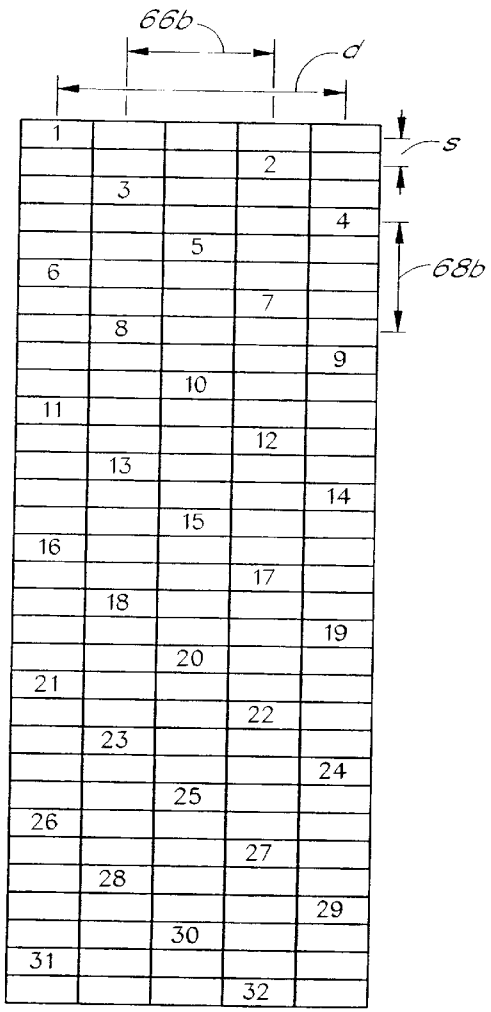
FIGS. 5A–5D schematically illustrate nozzle positions and firing orders for nozzle columns having four, five, and eight sub-columns.
Figure 5B:
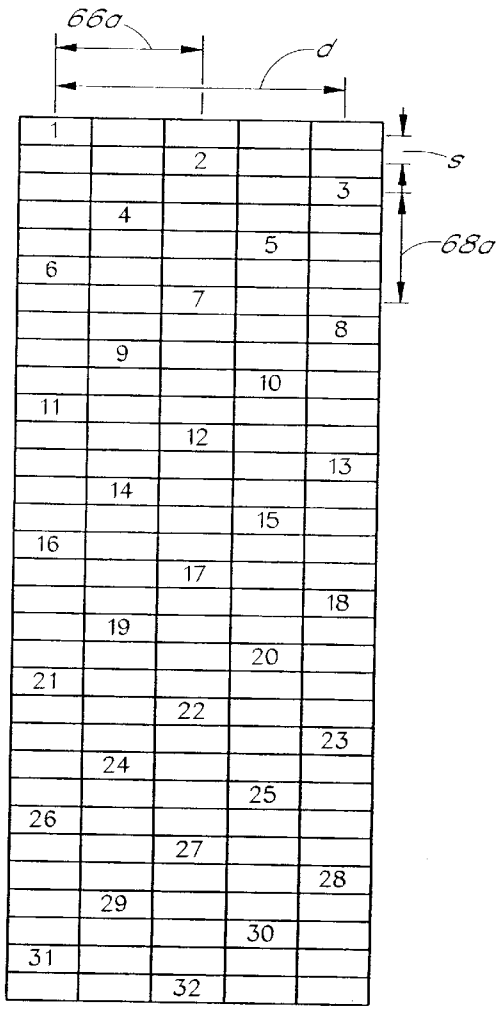
Figure 5A:
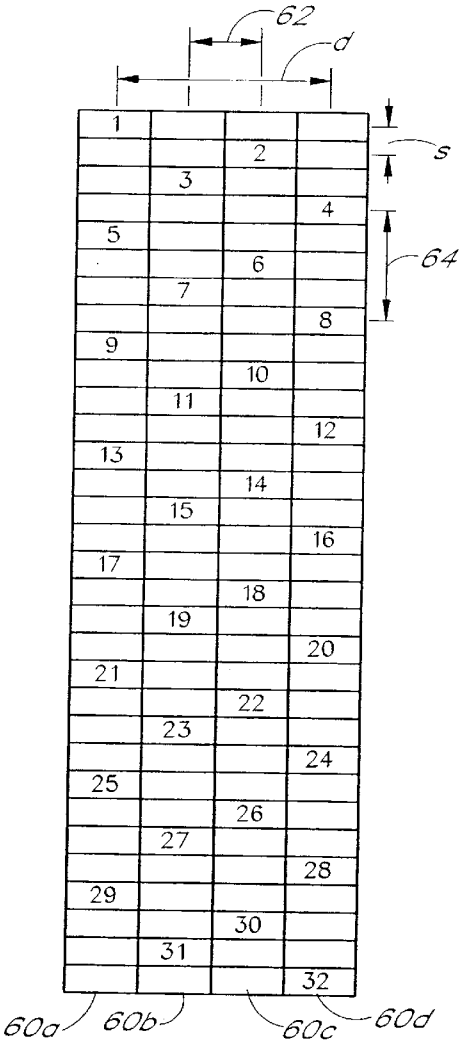

In FIG. 5A, a four sub-column embodiment is shown. In this embodiment, each of the four sub-columns 60*a*, 60*b*, 60*c*, and 60*d* include eight of the 32 nozzles. The top nozzle of these four columns are nozzles 1, 3, 2, and 4 respectively, and each sub-column includes every fourth nozzle thereafter. Although this four sub-column embodiment provides cross-talk reduction benefits, it may be noted that down the center two sub-columns 60*b*, 60*c*, nozzles which are vertically adjacent are also horizontally adjacent. For example, nozzle 3 is in the second sub-column, and nozzle 2 is in the third sub-column. The same is true of nozzles 7 and 6, 11 and 10, 15 and 14, 19 and 18, 23 and 22, 27 and 26, and 31 and. In addition, because sub-column 60*d* will be fired immediately following sub-column 60*a* as the sub-column 60*d* begins to move over the next pixel column, the two end sub-columns are also "adjacent" in a functional sense. Thus, vertically adjacent nozzles 4 and 5, 8 and 9, 12 and 13, 16 and 17, 20 and 21, 24 and 25, and 28 and 29 are also horizontally "adjacent." If the total column width is "d" (which as explained above, will be 3/4 times r, where r is a print resolution unit, for a four sub-column embodiment), the minimum horizontal separation 62 between two vertically adjacent nozzles in the four sub-column embodiment is equal to the distance between sub-columns, which will be d/3, i.e. r/4. It can also be seen that if the spacing between vertically adjacent nozzles is "s", the four column embodiment provides a vertical separation 64 between nozzles of 4s within each sub-column.

The four sub-column arrangement provides cross-talk reduction over a two sub-column arrangement mostly by providing a 4s vertical separation within each sub-column (rather than 2s for a two sub-column embodiment). Referring now to FIGS. 5B and 5C, however, it will be seen that a five sub-column arrangement is a further improvement. In the embodiment of FIG. 5B, the top nozzles of the five sub-columns are nozzles 1, 4, 2, 5, and 3 respectively. In the embodiment of FIG. 5C, the top nozzles are 1, 3, 5, 2, and 4 respectively. It may further be noted that the nozzle arrangement of FIGS. 3A and 3B is the same as that shown in FIG. 5C.

With the arrangements of FIGS. 5B and 5C, no two vertically adjacent nozzles are in horizontally adjacent sub-columns. Thus, for a given column width d, the minimum horizontal separation 66*a*, 66*b* between two vertically adjacent nozzles is two sub-column horizontal spacings, a total distance of d/2, or, expressed in terms of the horizontal print resolution unit r, (½)(4r/5), which is 2r/5. Also, with these five sub-column embodiments, the vertical spacing 68*a*, 68*b* between nozzles within each sub-column is 5s. Both of these values are larger than the r/4 and 4s values of the four sub-column embodiment of FIG. 5A. The five sub-column embodiment thus exhibits less cross-talk during print operations than the four sub-column embodiment.

Figure 5D:
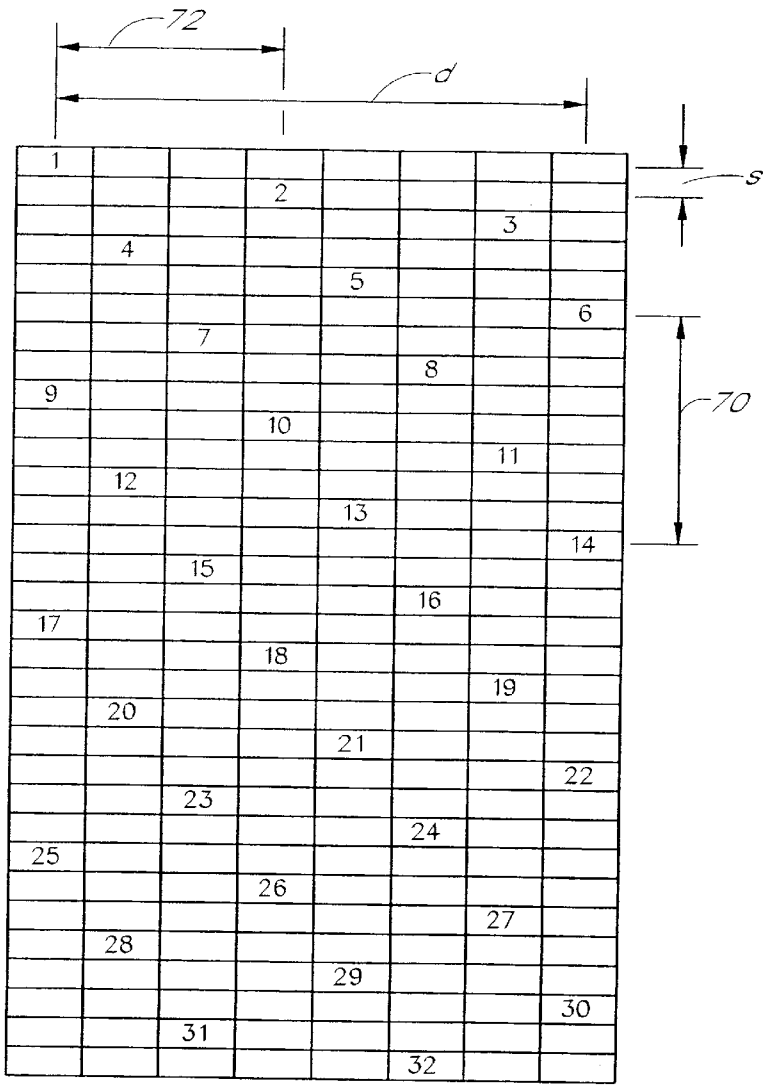

FIG. 5D for example, illustrates an eight sub-column arrangement. With this arrangement, the vertical distance 70 between nozzles within a sub-column will be 8s. Furthermore, with eight sub-columns, it is possible to arrange the nozzles such that no two vertically adjacent nozzles are horizontally positioned within two sub-columns of each other. The minimum horizontal separation 72 between vertically adjacent nozzles in this eight sub-column arrangement is therefore three sub-column horizontal spacings, which is equal to 3d/7 for a total column width of d, which is 3r/8 in terms of the print resolution unit. This is actually closer together than the 2r/5 distance of the five sub-column embodiment. The eight sub-column embodiment therefore provides larger vertical spacing within a sub-column, but reduced horizontal spacing between vertically adjacent nozzles.

Although the four, five, and eight sub-column embodiments all display good cross-talk reduction properties, the five sub-column embodiment has been found to be the most advantageous. The extra vertical and horizontal spacing provided over the four sub-column embodiment results in a significant additional reduction in cross talk. The embodiment of FIGS. 3A, 3B, and 5C, for example, produces droplet volume and velocity variations during printing of less than about 10%, which is usually less than the variations attributable to head manufacturing and other sources.

With regard to the eight sub-column embodiment of FIG. 5D, the eight sub-columns require eight enable signals rather than five, the nozzles must pass over each vertical pixel column slowly enough so that eight separate nozzle firings may be performed. In addition, the reduction in horizontal spacing over the five sub-column embodiment reduces the cross talk benefits achieved by the larger vertical spacing.

The extra time required to fire eight sub-columns, which is especially disadvantageous in piezoelectrically actuated print heads, coupled with a relatively small improvement in cross talk, makes the eight sub-column embodiment typically somewhat less desirable than the five sub-column embodiment.

Of course, six and seven sub-column embodiments may also be devised. However, with less than eight sub-columns, it is not possible to provide a minimum horizontal distance between vertically adjacent nozzles of more than two sub-column horizontal spacings, which is the same as is possible with the five sub-column embodiment. Thus, the minimum horizontal distance between vertically adjacent nozzles in the six and seven sub-column embodiments will be r/3 and 6r/21 respectively. Because these distances are closer than both the five and eight sub-column embodiments, these embodiments are typically less desirable than either the five or eight sub-column embodiments.

Nozzle columns arrangements having nine, ten, or more sub-columns tend to reduce the possible sub-column horizontal spacing to the point where the firing pulses for a piezoelectric print head will begin to overlap for adjacent sub-columns. Thus, embodiments having more than eight sub-columns are disadvantageous, especially for piezoelectric print head technology where the firing pulses are generally much longer than thermal print head technology.

Figure 6:
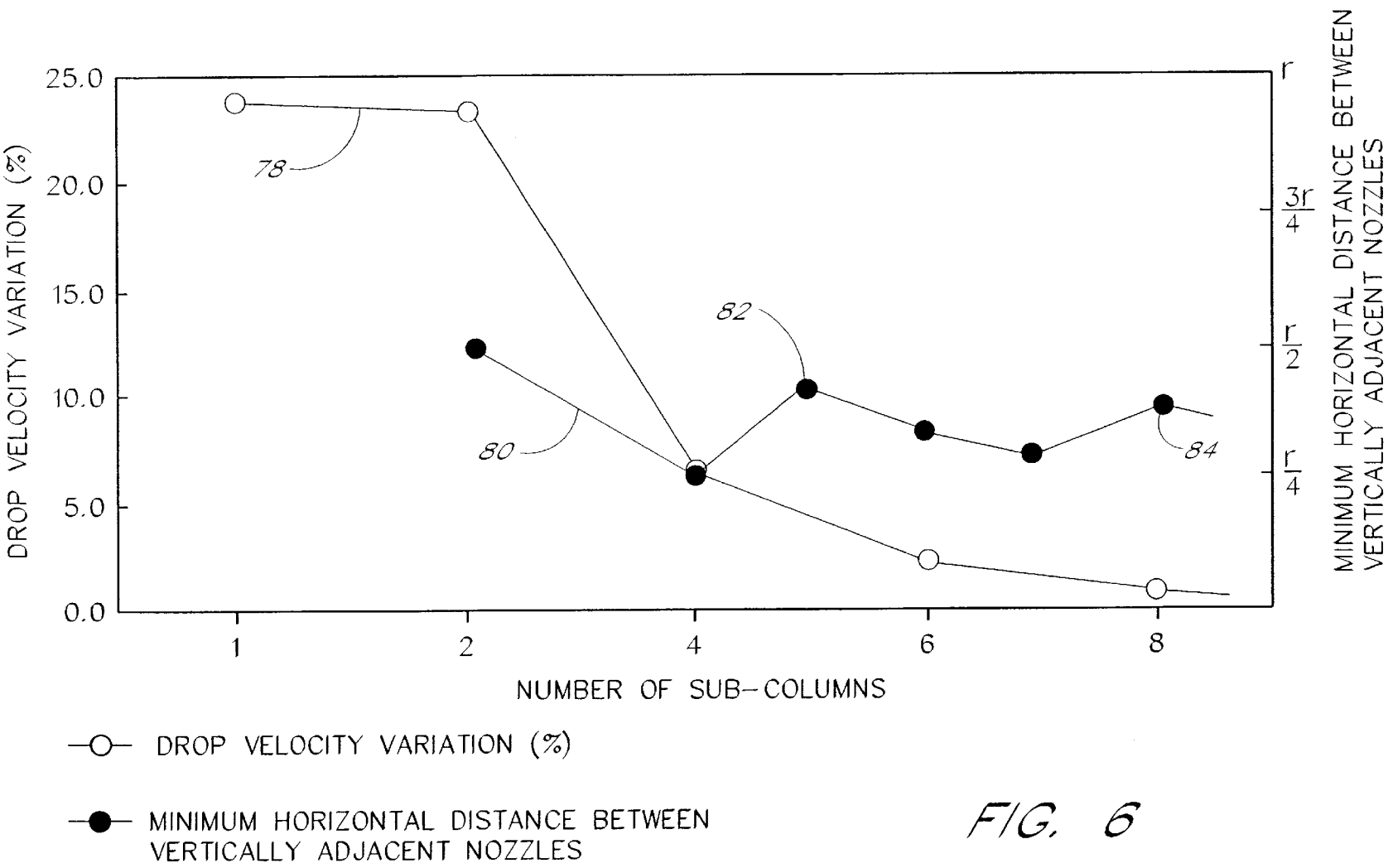
FIG. 6 is a graph of drop velocity variation and horizontal inter-nozzle spacing for nozzle arrangements with two to eight sub-columns.

FIG. 6 illustrates the above principles in a graphical format. Curve 78 of this Figure shows the percentage drop velocity variation for a selected nozzle when it is fired alone, and when it is fired simultaneously with the other nozzles in its sub-column. As can be seen in FIG. 6, the variation decreases with increasing numbers of sub-columns, as the vertical distance between simultaneously fired nozzles increases. A sharp drop between two and four sub-column embodiments has been observed, with a more gradual decline with increasing numbers of sub-columns above four.

Curve 80 shows the minimum horizontal separation between vertically adjacent nozzles in terms of the print resolution unit r. As can be seen with examination of this curve, peaks 82, 84 in the curve 80 occur at five and eight sub-columns. It may also be noted from curve 78 that relatively constant drop velocities are obtained at these points due to sufficient vertical spacing between nozzles within the sub-columns. Thus, these two embodiments have been determined to be preferred configurations of the invention.

Advantageous nozzle column arrangements thus include nozzle columns arranged as a plurality of sub-columns, where the column width, (defined by the total horizontal spacing between the leftmost sub-column and the rightmost sub-column) is "d", the vertical spacing between vertically adjacent nozzles of the column is "s", the minimum vertical spacing between adjacent nozzles within a sub-column is at least approximately 4s, and the minimum horizontal spacing between vertically adjacent nozzles of the column is at least approximately d/3. More preferably, the minimum horizontal spacing between vertically adjacent nozzles of the column is at least approximately 2d/5. In some embodiments, the minimum horizontal spacing between vertically adjacent nozzles of the column as a whole is at least approximately d/2. It is most preferable to have the minimum horizontal spacing between vertically adjacent nozzles of the column be at least approximately d/2, and the minimum vertical spacing between adjacent nozzles within a sub-column be at least approximately 5s. As discussed above, this may be accomplished with a five sub-column embodiment.

The foregoing description details certain embodiments of the invention. It will be appreciated, however, that no matter how detailed the foregoing appears in text, the invention can be practiced in many ways. As is also stated above, it should be noted that the use of particular terminology when describing certain features or aspects of the invention should not be taken to imply that the terminology is being re-defined herein to be restricted to including any specific characteristics of the features or aspects of the invention with which that terminology is associated. The scope of the invention should therefore be construed in accordance with the appended claims and any equivalents thereof.

What is claimed is:

1. An ink jet printer configured to deposit droplets of ink onto a grid of pixel locations, said grid of pixel locations defining a vertical print resolution unit and a horizontal print resolution unit, said ink jet printer comprising:

an ink jet print head comprising at least one vertically extending column of nozzles, wherein said column of nozzles is configured into five to eight horizontally separated sub-columns so as to reduce inter-nozzle cross talk during print operations, wherein the five to eight sub-columns are separated from one another such that the total width of said column is less than one horizontal print resolution unit, and wherein vertically adjacent nozzles of said column are situated in different ones of said sub-columns in such a way that no two vertically adjacent ink ejection nozzles within said column are in either the same sub-column or are in two horizontally adjacent sub-columns.

2. The ink jet printer of claim 1, comprising five sub-columns.

3. The ink jet printer of claim 2, wherein vertically adjacent nozzles of said column are separated by at least ⅖ of said horizontal print resolution unit.

4. The ink jet printer of claim 1, wherein said nozzles of said column extend in a first direction, wherein said sub-columns are spaced apart from one another in a second direction perpendicular to said first direction a distance of approximately four to approximately thirty microns.

5. The ink jet print head of claim 4, wherein said adjacent sub-columns are spaced at least approximately eight microns apart in a direction perpendicular to said first direction.

6. The ink jet print head of claim 4, comprising exactly five sub-columns.

7. The ink jet print head of claim 6, wherein said adjacent sub-columns are spaced at least approximately eight microns apart in a direction perpendicular to said first direction.

8. The ink jet print head of claim 4, wherein each of said nozzles is coupled to an ink chamber.

9. The ink jet print head of claim 4, wherein each of said ink chambers is coupled to a piezoelectrically actuated ink ejector.

10. The ink jet printer of claim 1 wherein the column of ink ejection nozzles are arranged as a plurality of sub-columns such that (1) nozzles within each sub-column are separated by a distance sufficient to reduce drop velocity variations during print operation to less than about 10%, and such that (2) the horizontal distance between neighboring sub-columns is approximately 12–25% of said pixel to pixel distance such that long firing pulses may be used without significantly impacting print speed.

11. The ink jet printer of claim 10, wherein said column of nozzles is arranged as five sub-columns.

12. The ink jet printer of claim 10, wherein said column of nozzles is arranged as eight sub-columns.

13. An ink jet printer comprising:

a platen forming a print surface;

a media drive system configured to increment print media in a first direction over said print surface;

a movable print carriage configured to pass over said print media in a second direction perpendicular to said first direction between media drive system increments;

a piezoelectrically actuated drop-on-demand print head coupled to said moveable print carriage, wherein said drop-on-demand print head comprises one or more columns of nozzles extending in said first direction, each of which are arranged in five parallel sub-columns, wherein total horizontal spacing between the leftmost sub-column and the rightmost sub-column is d, wherein the vertical spacing between vertically adjacent nozzles of the column of nozzles is s, wherein the minimum vertical spacing between adjacent nozzles within a sub-column is at least approximately 5s, and wherein the minimum horizontal spacing between vertically adjacent nozzles of the column is at least approximately d/2, and wherein nozzle separation between said sub-columns in said second direction is approximately four to approximately thirty microns.

14. An ink jet printer configured to deposit droplets of ink onto a grid of pixel locations, said grid of pixel locations defining a vertical print resolution unit and a horizontal print resolution unit, said printer comprising:

a print surface;

a drop-on-demand print head mounted adjacent to said print surface, wherein said drop-on-demand print head comprises a column of nozzles extending in a first direction, wherein said column of nozzles is arranged in five to eight parallel sub-columns, and wherein said sub-columns are spaced apart in a second direction perpendicular to said first direction such that the total width of the column of nozzles is less than one horizontal print resolution unit and wherein vertically adjacent nozzles of said column are situated in different ones of said sub-columns in such a way that no two vertically adjacent ink ejection nozzles within said column are in either the same sub-column or are in two horizontally adjacent sub-columns.

15. The ink jet printer of claim 14, wherein separation between adjacent sub-columns in said second direction is approximately four to approximately thirty microns.

16. The ink jet printer of claim 14, comprising exactly five sub-columns.

17. The ink jet printer of claim 16, wherein separation between adjacent sub-columns in said second direction is at least approximately eight microns.

18. An ink jet print head configured to deposit droplets of ink onto a grid of pixel locations, said grid of pixel locations defining a vertical print resolution unit and a horizontal print resolution unit, wherein said print head comprises a column of ink ejection nozzles which is arranged in five, six, seven, or eight parallel sub-columns, wherein the five to eight sub-columns are separated from one another such that the total width of said column is less than one horizontal print resolution unit, and wherein vertically adjacent nozzles of said column are situated in said sub-columns in such a way that no two vertically adjacent ink ejection nozzles are in either the same sub-column or are in two horizontally adjacent sub-columns.

19. The ink jet print head of claim 18, wherein said parallel sub-columns are spaced apart between approximately four and approximately 30 microns.

20. An ink jet print head for depositing ink droplets onto media pixel locations, wherein said ink jet print head comprises at least one column of nozzles, wherein said column of nozzles are arranged as a plurality of sub-columns, wherein total horizontal spacing between the leftmost sub-column and the rightmost sub-column is d, wherein the vertical spacing between vertically adjacent nozzles of the column of nozzles is s, wherein the minimum vertical spacing between adjacent nozzles within a sub-column is at least approximately 5s, and wherein the minimum horizontal spacing between vertically adjacent nozzles of the column is at least approximately 2d/5.

21. The ink jet print head of claim 20, wherein the minimum horizontal spacing between vertically adjacent nozzles of the column is at least approximately d/2.

22. The ink jet print head of claim 21, wherein the minimum vertical spacing between adjacent nozzles within a sub-column is at least approximately 8s.

* * * * *